United States Patent [19]

Parramore

[11] Patent Number: 4,521,932

[45] Date of Patent: Jun. 11, 1985

[54] TRANSPORTABLE BRIDGE STRUCTURE

[75] Inventor: Thomas S. Parramore, Bournemouth, England

[73] Assignee: Fairey Engineering Limited, Stockport, England

[21] Appl. No.: 447,550

[22] Filed: Dec. 7, 1982

[30] Foreign Application Priority Data

Dec. 8, 1981 [GB] United Kingdom ..... 8137003

[51] Int. Cl.[3] ..... E01D 15/12

[52] U.S. Cl. ..... 14/2.4; 14/17

[58] Field of Search ..... 14/2.4, 2.6, 17, 73, 14/1

[56] References Cited

U.S. PATENT DOCUMENTS

| | | | |
|---|---|---|---|
| 1,900,867 | 3/1933 | Olds | 14/1 X |
| 3,411,167 | 11/1968 | Sedlacek | 14/14 X |
| 3,504,389 | 4/1970 | Longbottom | 14/13 |
| 3,651,528 | 3/1972 | Behrmann et al. | 14/27 X |
| 3,832,748 | 9/1974 | Ogletree | 14/1 |
| 4,015,303 | 4/1977 | Eyb et al. | 14/1 X |
| 4,288,881 | 9/1981 | Mahncke et al. | 14/2.4 |
| 4,353,190 | 10/1982 | Gleeson | 14/17 X |

FOREIGN PATENT DOCUMENTS

| | | | |
|---|---|---|---|
| 2807789 | 8/1978 | Fed. Rep. of Germany | 14/2.4 |
| 2900861 | 7/1980 | Fed. Rep. of Germany | 14/2.4 |
| 2502659 | 10/1982 | France | 14/2.4 |
| 2039311 | 8/1980 | United Kingdom | 14/2.4 |

*Primary Examiner*—Stephen J. Novosad
*Assistant Examiner*—Beverly E. Hjorth
*Attorney, Agent, or Firm*—Millen & White

[57] ABSTRACT

A bridge module comprises two longitudinal main girder structures and a central deck having a deck surface, said main girder structures being foldably connected are along each side of said central deck and being foldable between an operative position in which said main girder structures offer extensions of said deck surface on either side of said central deck for use and a closed position in which said main girder structures are folded beneath said deck.

23 Claims, 51 Drawing Figures

Fig.15
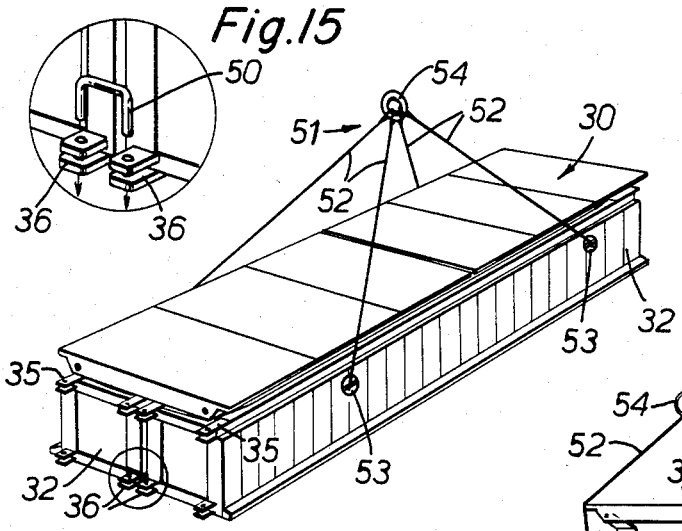
FIG. 15A.
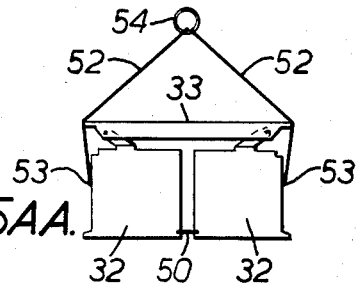
FIG.15AA.
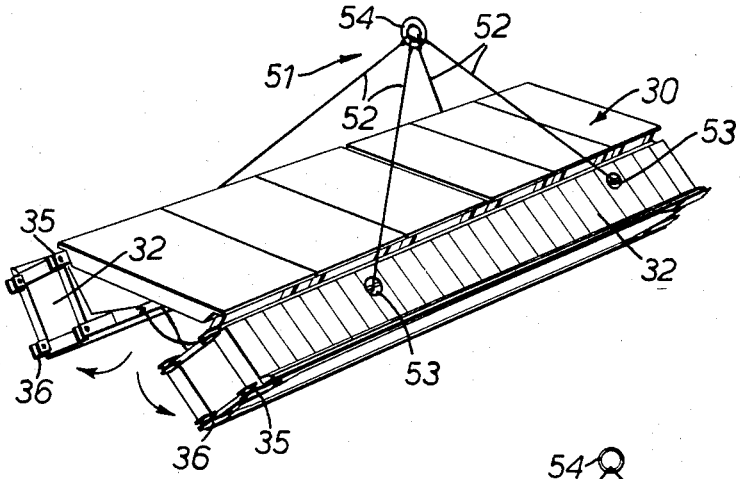
FIG.15B.
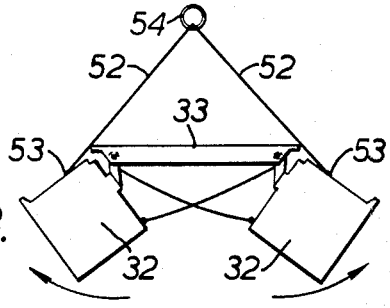
FIG.15BB.

Fig17
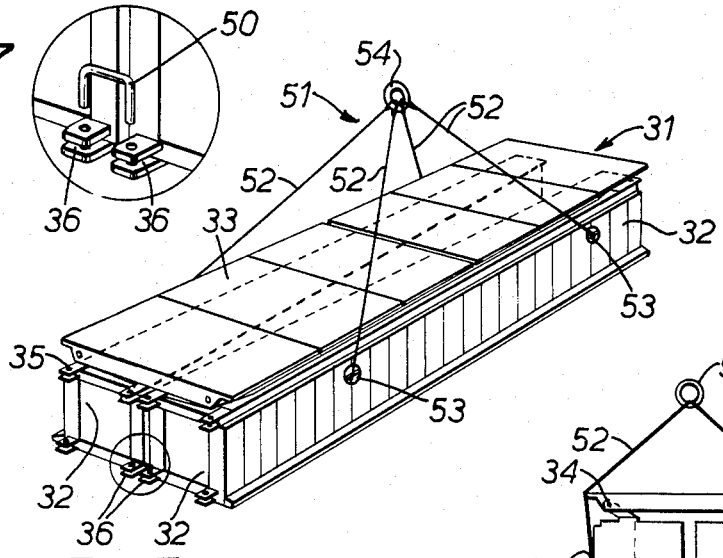
FIG. 17A.
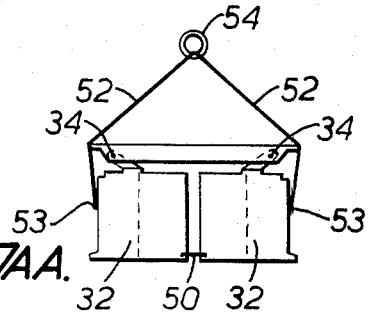
FIG. 17AA.
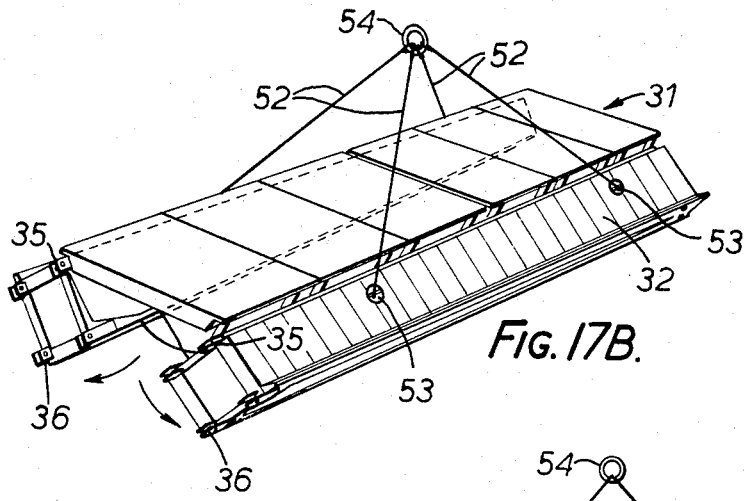
FIG. 17B.
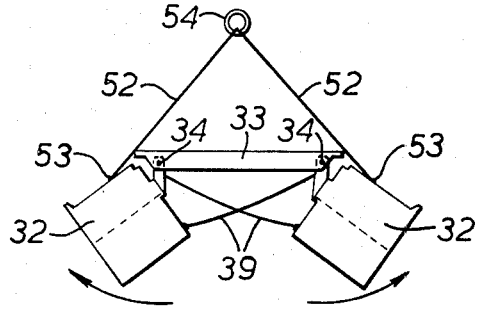
FIG. 17BB.

111
116
115
113
113
114
112
110

116
115
111
114
114
31
30
30
30
31

114
115
111
31
30
30
30
31
110
112

TRANSPORTABLE BRIDGE STRUCTURE

BACKGROUND OF THE INVENTION a. Field of the Invention

This invention relates to a bridge module, a plurality of which may be transported in folded form to a site and assembled on site to form a bridge.

b. Description of the Prior Art

It is known that bridges can be assembled from a spaced-apart pair of main girders which are appropriately positioned and from deck members subsequently positioned to span the space between the main girders. In military applications, the main girders are often spaced apart such that each can receive a respective track of a heavy vehicle such as a tank. The deck members are needed so that lighter vehicles which are narrower than tanks can also use the bridge once assembled.

It can take a considerable time to build bridges in this way, often under circumstances in which time is at a premium. Further, for a bridge of a given length to be assembled in as short a time as possible, it is desirable for the components to be as large as possible so that only a few of them need be joined together. However, the transportation of long bridge girders and lrge deck members poses many problems.

SUMMARY OF THE INVENTION

It is an object of the invention to provide a bridge module which is readily transportable and assemblable to form a bridge, offers durability in use, and does not impose unduly restrictive limits on vehicles using a bridge formed of the modules. The bridge module may be relatively light weight.

It is a further object of the invention to provide a bridge module which may be used for the assembly of a bridge for spanning gaps in terrain, typically between the banks of a river or canal or other channel.

It is a still further object of the invention to provide a bridge module which may be used for the assembly of a bridge for unloading vehicles from a deck of a ship to a dock side, in particular onto a floating dock deck.

It is another object of the invention to provide a bridge module which may be transported and stored on a container-sized pallet. Such container sided pallets are preferably to ISO specifications and are arranged to carry two bridge modules.

Thus in one aspect the present invention provides a bridge module comprising two longitudinal main girder structures and a central deck having a deck surface, said main girder structures being foldably connected one along each side of said central deck and being foldable between an operative position in which said main girder structures offer extensions of said deck surface on either side of said central deck for use and a closed position in which said main girder structures are folded beneath said deck.

Thus the main girder structures may be compactly folded beneath the deck structures to form a readily manipulatable unit.

In another aspect, the invention provides a bridge module comprising two longitudinal main girder structures and a central deck having a deck surface, said main girder structures being foldably connected one along each side of said central deck and being foldable between an operative position in which said main girder structures offer extensions of said deck surface on either side of said central deck for use and a closed position in which said main girder structures are folded beneath said deck and wherein said main girder structures are longitudinally tapered in depth when seen from a side of the module in its operative position, whereby the module forms an end ramp of a bridge.

The invention also extends to a bridge comprising at least one central bridge module and two end bridge modules, each of said bridge modules comprising two longitudinal main girder structures and a central deck having a deck surface, said main girder structures being foldably connected one along each side of said central deck and being foldable from an operative position in which said main girder structures offer extensions of said deck surface on either side of said central deck for use to a closed position in which said main girder structures are folded beneath said deck, said main girder structures of said and bridge modules being longitudinally tapered in depth when seen from a side of said module in its operative position, said main girder structures of said central bridge module(s) not being so tapered and, wherein each of said end bridge modules and said central bridge module(s) is in said operative position and wherein said end bridge modules and said central bridge modules are connected together to form a bridge.

BRIEF DESCRIPTION OF THE DRAWINGS

In order to provide a fuller understanding of the above and other aspects of the present invention an embodiment will now be described by way of example only with reference to the accompanying drawings in which.

DETAILED DESCRIPTION OF THE PREFERRED EMBODIMENT

Figure 1:
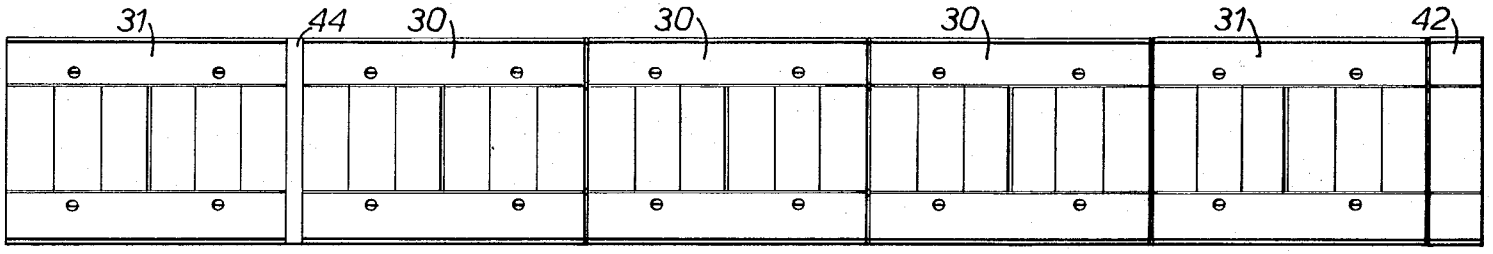
FIG. 1 shows a plan view of a bridge.
Figure 2:
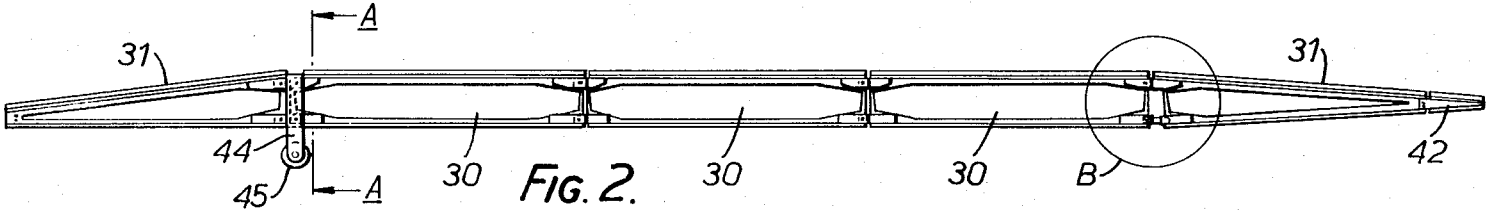
FIG. 2 shows a side elevation of the structure of FIG. 1.

FIGS. 1 and 2 show in plan and side elevation a bridge structure embodying the invention. The structure comprises three non-tapered modules 30 forming the central part of the bridge and two tapered modules 31 forming respective ends of the bridge. The modules 30 and 31 are releasably attached together so that they can be assembled as shown or dismantled for transportation as separate pieces.

FIGS. 5,6,7 and 8 show in more detail one of the modules 30. Each module comprises two main girder structures 32 arranged one on each side of the module as load-bearing elements. A series of deck panels 33 are arranged transversely between the main girder structures 32 to complete a deck surface as indicated at 134 in FIGS. 5,6 and 7. Each end of the girder structures 32 is provided with upper and lower junction plates 35 and 36 for the connection to the ends of other modules of a bridge. The upper and lower junction plates are arranged to engage in an interweaving fashion and are formed with apertures through which a junction pin may be inserted to join the modules together and transmit loads through the main girder structures. The upper and lower junction plates are provided in groups, in the particular embodiment shown groups of two, at each corner of the cross-section of the main girders 32. Thus a series of modules may be connected together to form a span as shown in FIGS. 1 and 2.

The deck panels 33 are hingedly connected to the upper inner corners of the main girders 32. Thus the module may be folded from the open or operational condition as shown in FIG. 7 where the usable deck width comprises the uppermost surfaces of the main girders and of the deck panels in between; and a folded transport condition as shown in FIG. 8 where the main girder members 32 are folded inwards and under the centre deck panels 33.

Figure 9:
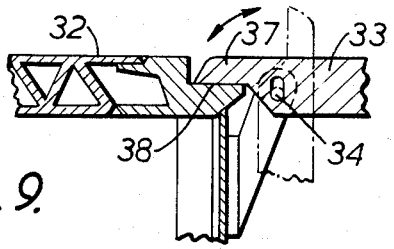
FIG. 9 is a detailed view of the hinge mechanism shown in FIGS. 7 and 8, FIGS. 10, 11,12, 13 and 14 show corresponding views of FIGS. 5,6,7, 8 and 9 of an end module of the bridge of FIG. 1.
Figure 10:
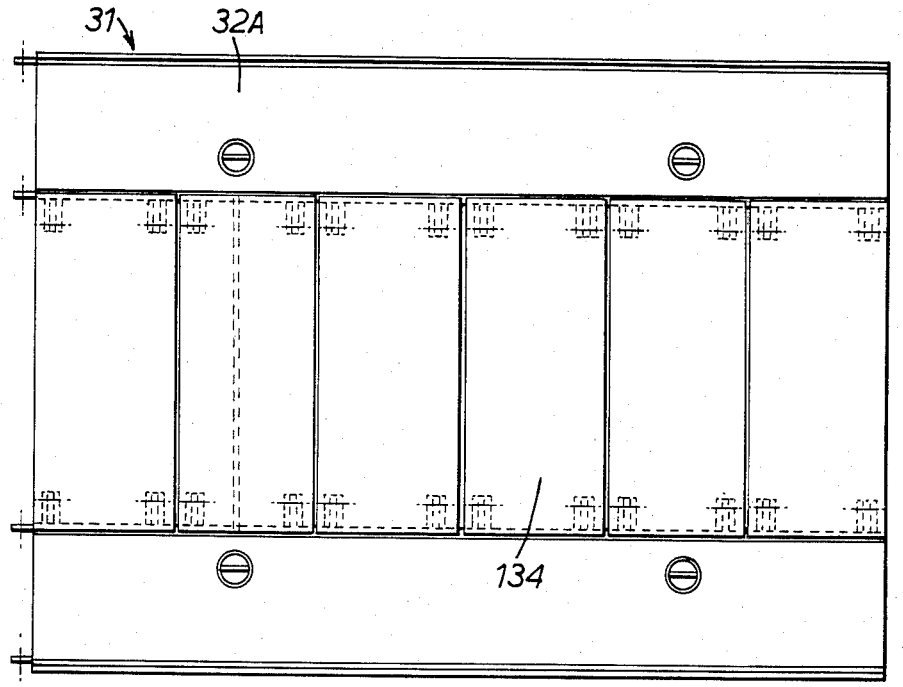
Figure 11:
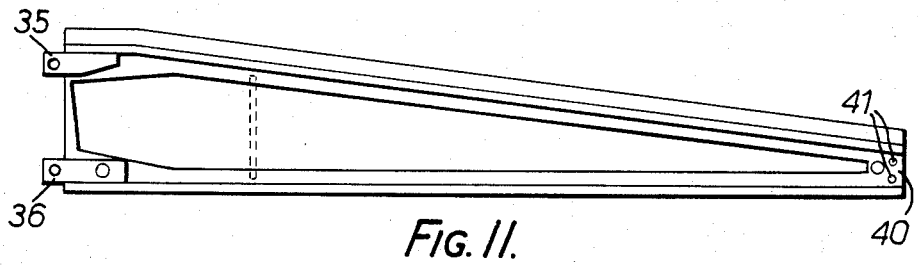
Figure 12:
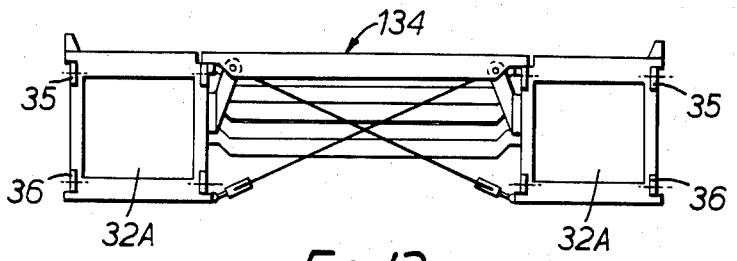
Figure 13:
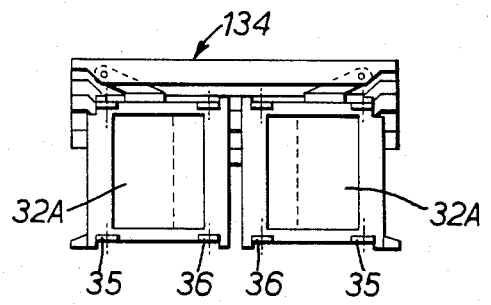
Figure 14:
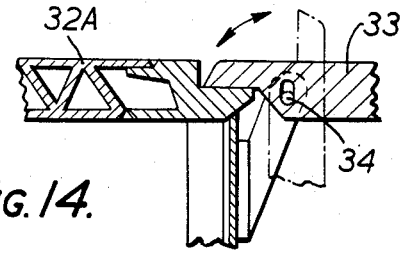

FIG. 9 shows in schematic part cross-section the hinge arrangement between the main girder 32 and a deck panel 33. A hinge pin 34 is attached to the inner side face of the main girder 32 by means of a bracket, and engages in a slot formed in part of the structure of the panel 33. The hinge pin 34 provides for the hinging action, while the slot allows the outer lip 37 of the deck panel 33 to rest on a shoulder 38 formed along the upper inner corner of the main girder 32. By this means any load on the deck panel 33 is transmitted directly to the main girder structure without being transmitted through the hinge pin 34.

Figure 7:
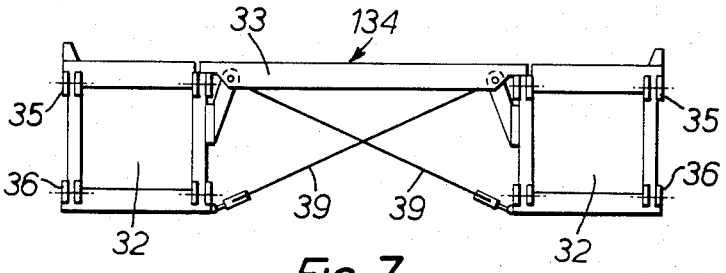
FIG. 7 shows an end view of the module of FIG. 5 in an operational condition.
Figure 8:
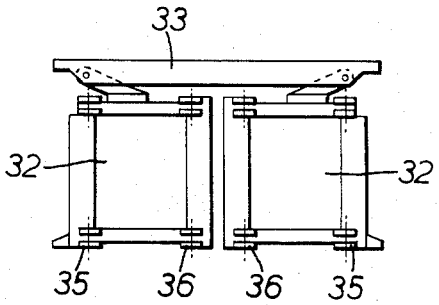
FIG. 8 shows a view similar to that of FIG. 7 in a closed condition.

As seen in FIG. 7, in the open condition, further opening movement of the main girders relative to the deck panels 33 is prevented by steel bracing wires 39. The wires 39 are shown in diagonal configuration, but it will be appreciated that they may extend between the inner bottom corners of the griders 32.

FIGS. 10, 11, 12, 13 and 14 correspond to FIGS. 5, 6, 7, 8 and 9 but depict one of the tapered end modules 31. The arrangement of the modules 31 is exactly similar to that discussed above and the components are given the same reference numbers. The main difference between the modules lies in that the main girder members 32A of the modules 31 are tapered in depth, in their open condition, to one end to provide an entry ramp to the bridge assembly. The inner end of the module 31 is provided with upper and lower joining plates 35 and 36, whereas the outer tapered end is provided with end flanges 40 having apertures 41 to receive pins by which to connect to the end 40 a final wedge shaped end portion indicated at 42 in FIGS. 1 and 2.

The module 31 folds in an exactly similar fashion to the module 30.

Figure 4:
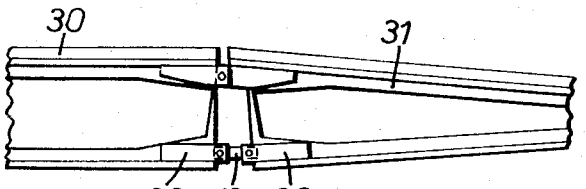
FIG. 4 shows an enlarged detailed view of B in FIG. 2.
Figure 3:
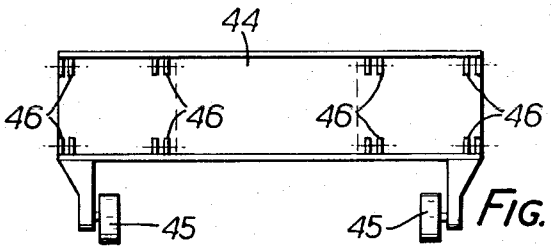
FIG. 3 shows a detailed view in cross section taken along the line A—A of FIG. 2.
Figure 5:
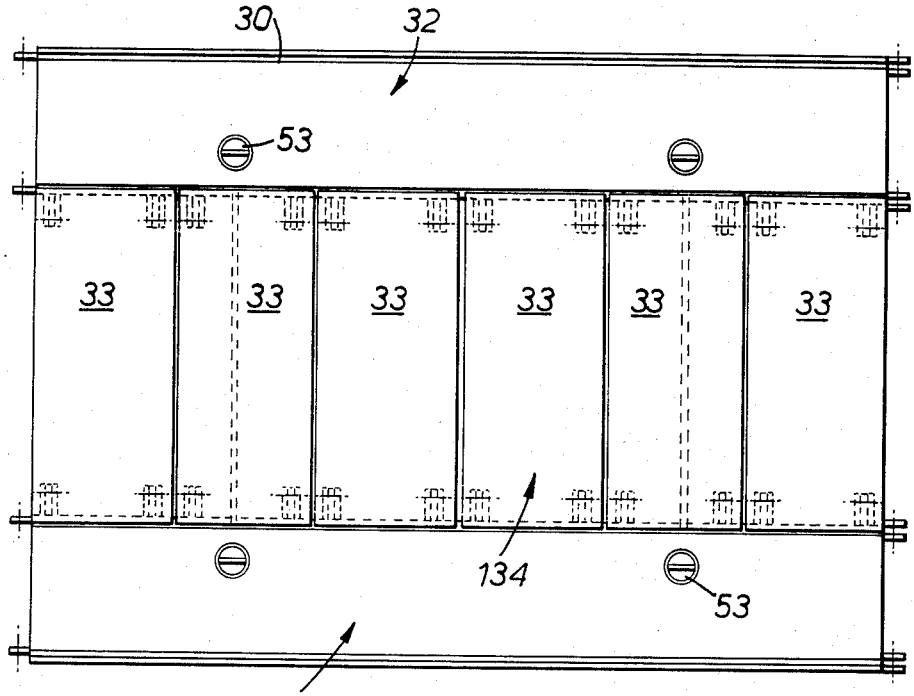
FIG. 5 shows a plan view of a main or center module of the structure of FIG. 1.
Figure 6:
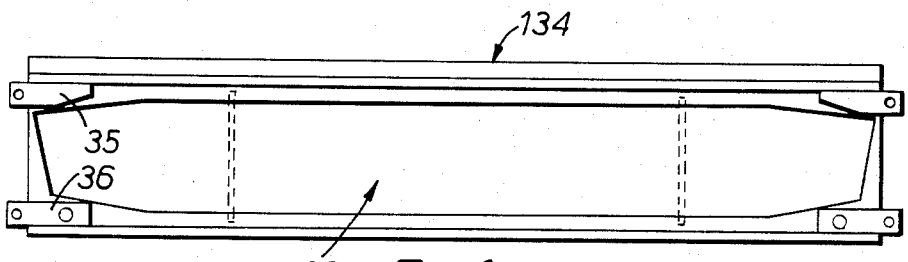
FIG. 6 shows a side elevation view of the module of FIG. 5.

If it is desired to alter the angle of approach offered by the tapered module 31, this can be reduced by putting additional links 43 between the lower joining plates 36 connected to the module 31 to the adjacent module 30 as indicated in FIG. 4.

If for reasons which are discussed below, it is desired to support part of an assembled bridge on wheels or rollers, a beam 44 carrying rollers 45 may be interposed between any two modules as indicated in FIGS. 1 and 2. The beam 44 is connected to the upper and lower joining plates 35 and 36 by means of mating trunnions 46 and suitable pins in a similar manner to that in which the modules are joined to one another.

Figure 15C:
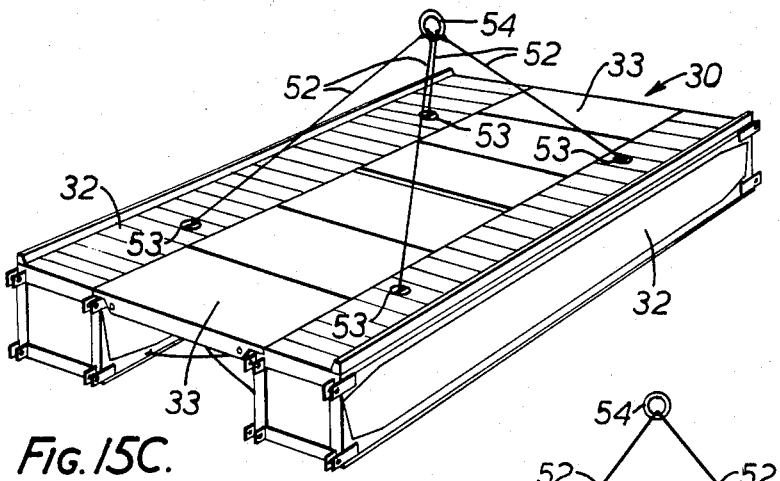
FIGS. 15A, 15A′ 15B and 15C show perspective views of stages of lifting a folded module and unfolding it to the open position, FIGS. 15AA, 15BB and 15CC show schematic end elevational views corresponding to FIGS. 15A, 15B and 15C.
Figure 15C:
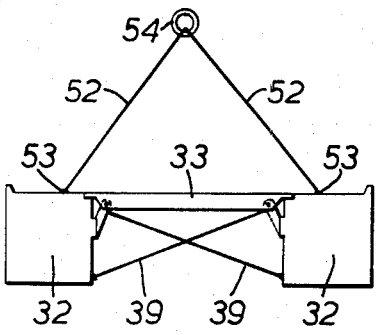

FIGS. 15A, 15B and 15C and FIGS. 15AA, 15BB and 15CC show the use of a lifting harness for firstly unfolding a module from its stored position to its open position, and subsequently for manoeuvering the module into a position of use.

As shown in FIG. 15A, 15A', the modules are retained in their closed position by means of U-shaped security pins 50 bridging the outer lower joining plates 36 of the main girders 32. The lifting harness 51 having four arms 52, being formed of wire rope or suitable material is attached to the module by means of recessed attachments 53 provided in the operative upper surfaces of the girder members 32. Thus when the module is lifted by the harness 50 by means of a centre ring 54 the action is first to unfold the module as shown in FIGS. 15B and 15BB to its open condition as shown in FIGS. 15C and 15CC for positioning in use.

As seen in FIG. 15B, the positioning of the attachments 53 is chosen so that the moment of force acting about the pins 34 during opening is controlled to minimize the shock loading on the wires 39 when the module opens.

Figure 16:
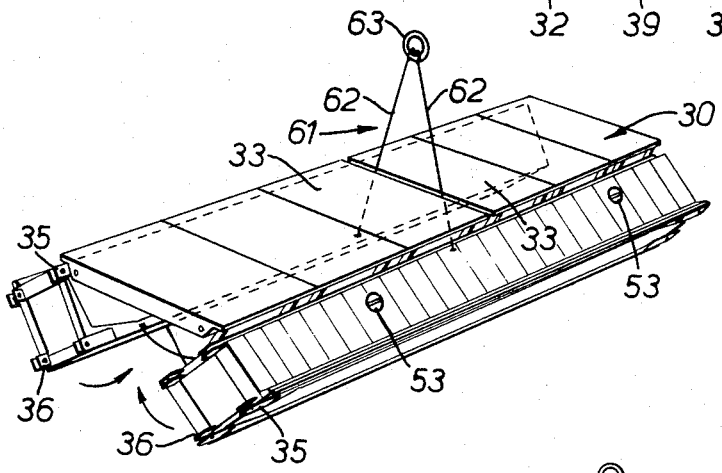
FIG. 16 shows a perspective view of the folding of the module in the closed position.
Figure 16A:
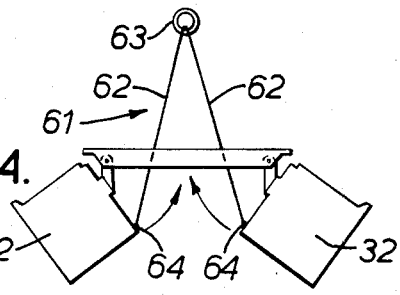
FIG. 16A shows a schematic end elevational view corresponding to FIG. 16, FIGS. 17A, 17A′ 17B and 17C show similar views to FIGS. 16A, 16B and 16C only for an end module, FIGS. 17AA, 17BB and 17CC show schematic end elevational views corresponding to FIGS. 17A, 17B and 17C.

FIGS. 16 and 16A show the lifting and closing of a module with a harness indicated at 61. The harness 61 has two arns 62 from a central ring 63, the arms 62 being attached at 64 to the bottom inner edges of the main girders 32 of the module in its open condition. The harness 61 extends upwards through a transverse gap between deck panels 33 in the center of the module. Thus as can be seen in FIG. 16 when the module is lifted by the ring 53, the first action will be to fold the girder members 32 inwards to the closed position after which the module can be lifted in its closed position with the pins 50 inserted.

Figure 17C:
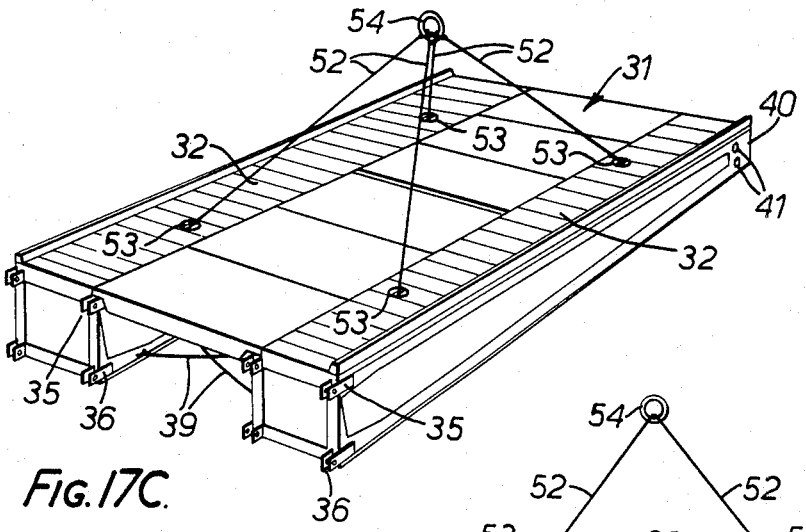
Figure 17C:
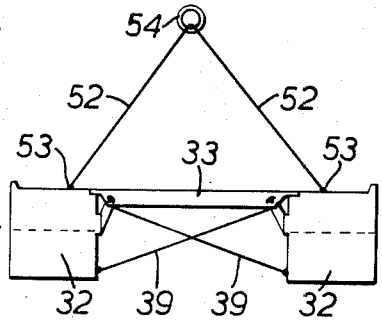
Figure 18:
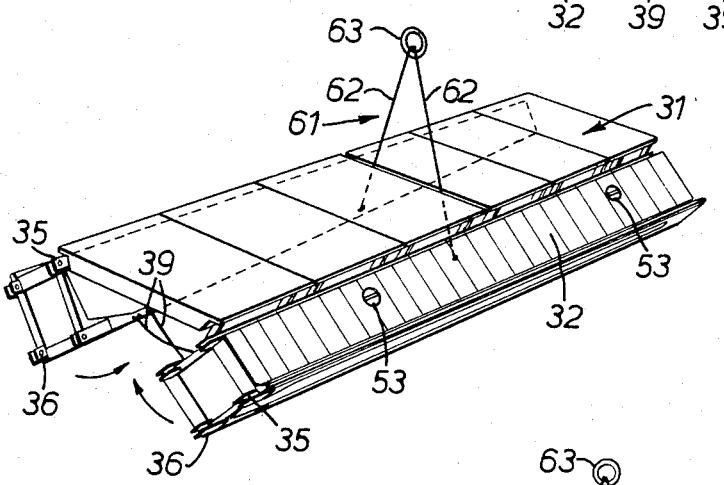
FIG. 18 shows a similar view of FIG. 16 only for an end module.
Figure 18A:
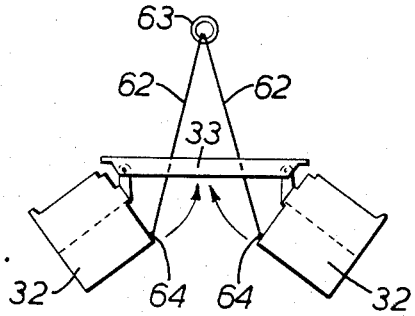
FIG. 18A shows a schematic end elevational view corresponding to FIG. 18.

FIGS. 17A, 17A', 17B, 17C, 17AA, 17BB, 17CC and FIGS. 18 and 18A correspond exactly to FIGS. 15A, 15B, 15C, 15AA, 15BB, 15CC and FIGS. 16 and 16A but show a tapered module 31 instead of a module 30.

FIGS. 19A, 19B, 19C and 19D show how the various modules 30 and 31 together with the accessories such as the beam 44 and the end wedges 42 may be packed on standard container sized pallets.

Figure 19A:
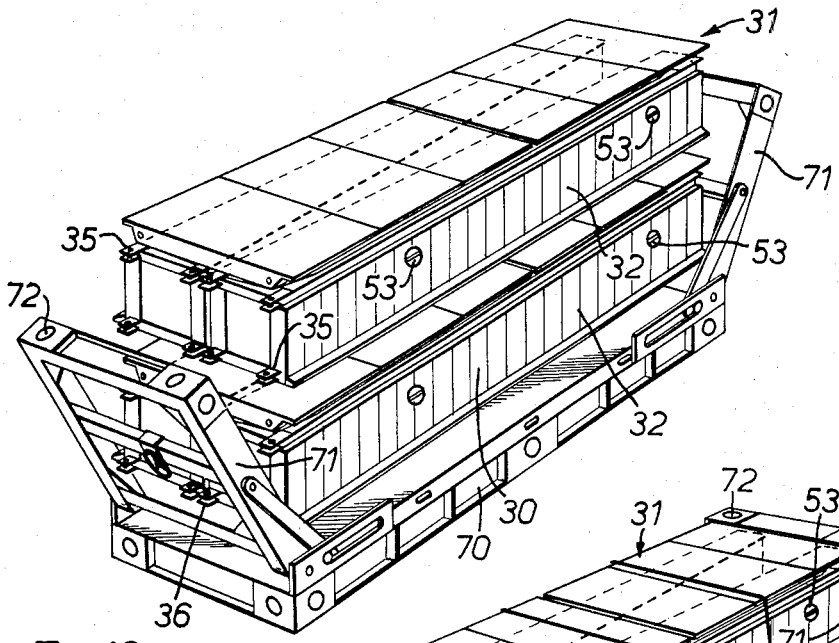
FIGS. 19A, 19B and 19C show various views of the modules of FIG. 1 packaged on a container pallet.
Figure 19B:
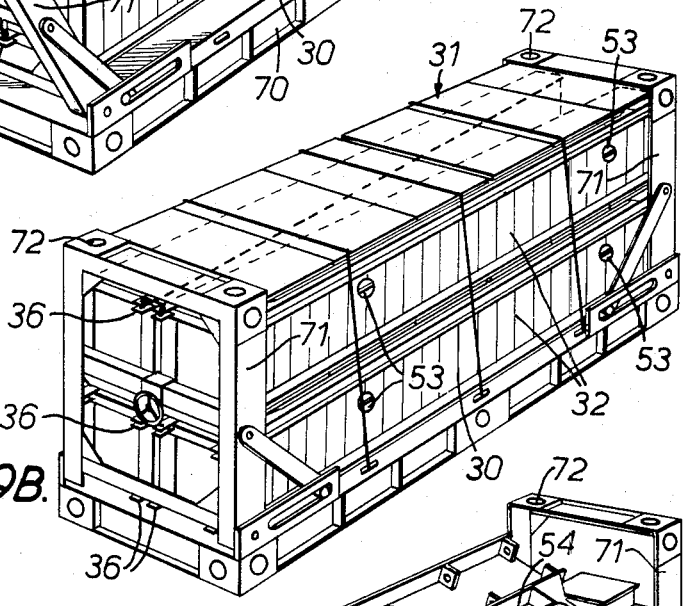

FIG. 19A shows how a module 30 and a module 31 may be packed on a pallet 70. The pallet 70 has two end frames 71 foldably attached at respective ends of the pallet so that when the modules are loaded on to the pallet as shown in FIG. 19A, they can be moved up to a vertical position as shown in FIG. 19B to complete the rectangular box shape of a container so that the two modules may be transported and handled if containerized. In particular, the pallet and end frame is provided with sockets 72 at appropriate places to receive twistlocks associated with conventional container handling and transporting equipment, and the base of the pallet is provided with slots to receive the arms of a forklift truck for handling the pallet.

Figure 19C:
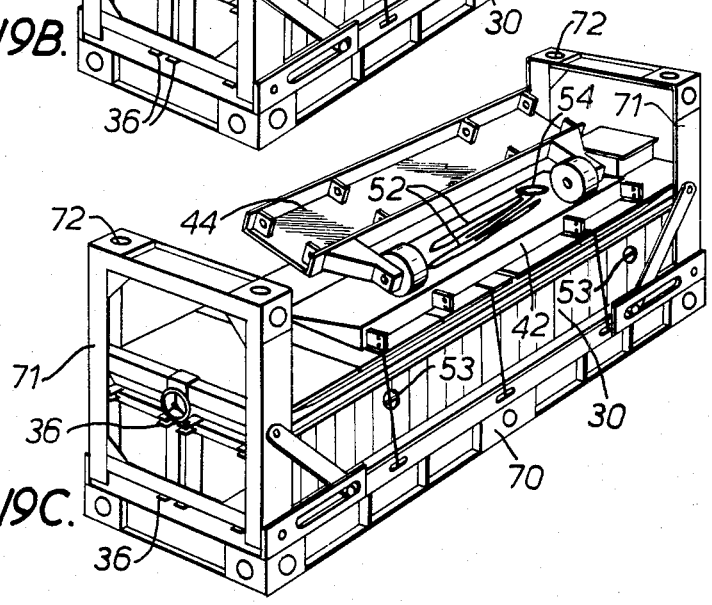

FIG. 19C shows how one module 39 together with the various accessories may be similarly packed on a container sized pallet 70.

Preferably the container sized pallet 70 conforms to ISO standards in size and configuration.

Thus it can be seen how the bridge shown in FIGS. 1 and 2 comprising five modules and accessories can be carried on three container pallets as indicated in effect in FIGS. 19A, 19B and 19C.

Figure 20:
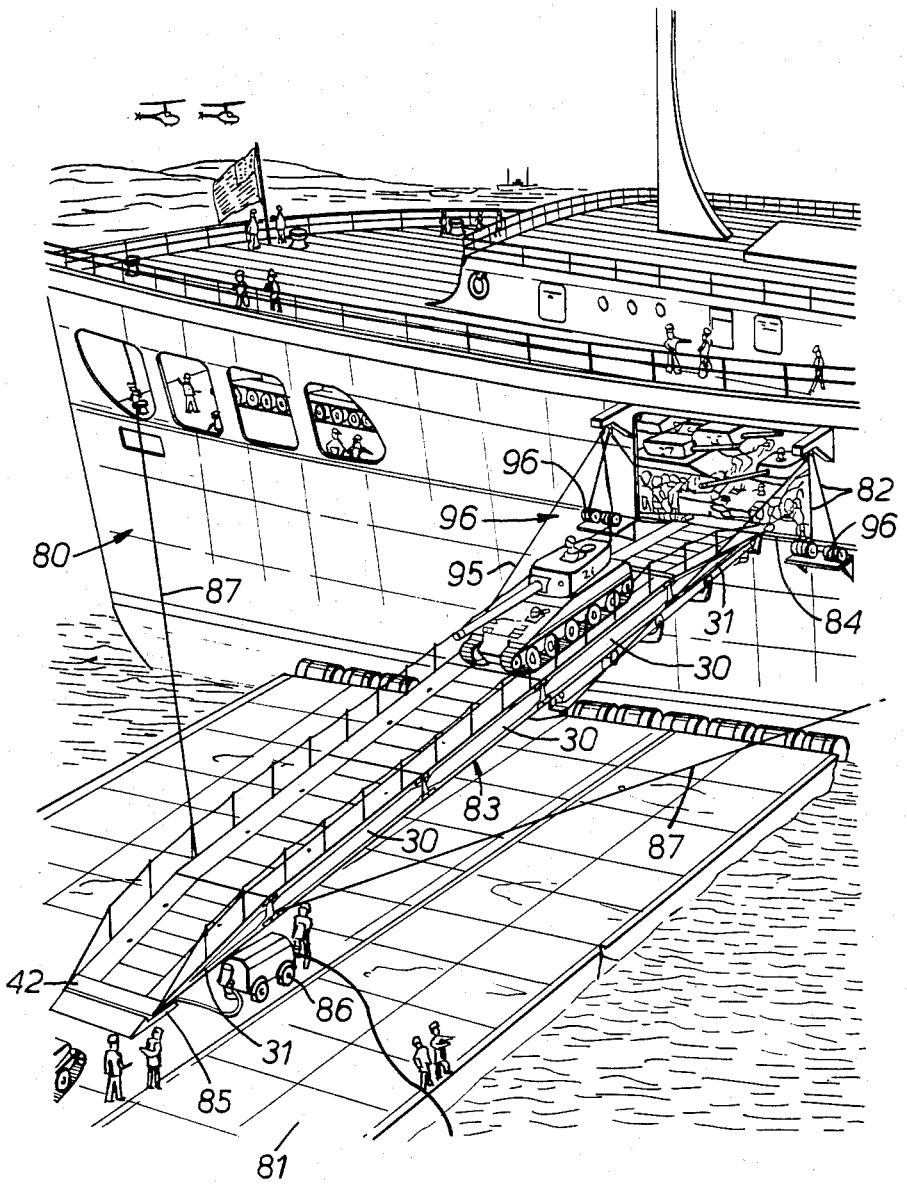
FIG. 20 shows a bridge structure of FIG. 1 in use between a ship and a dock.

FIG. 20 shows a bridge assembly of the type shown in FIGS. 1 and 2, assembled and arranged for unloading vehicles from a ship 80 to a floating deck 81. The ship has an access opening 82 in the side of the ship, and a bridge structure 83 comprising three modules 20 and two modules 31, is arranged between the lower edge 84 of the aperture and the deck 81. The lower end wedge portion 42 attached to the lower module 31 is supported on the deck 81 by means of a pressurised water slipper pad 85, which is of known design per se, supplied by water under pressure by a power unit 86. The bridge structure 83 is located angularly relative to the ship by means of guide wires 87. Thus it can be seen that the bridge structure 83 provides for the transport of vehicles from the ship to the deck 81.

It should be noted that with the connection and support of the deck panels 33 on the main girder members 32 the whole bridge assembly is given an element of flexibility. Thus with the operation of the support pad 85, the whole structure can accommodate for motion between the ship and the deck.

FIGS. 22A, 22B, 22C, 22D, 22E, 22F and 22G show various stages of the assembly of the bridge structure 83 of FIG. 20.

Figure 21:
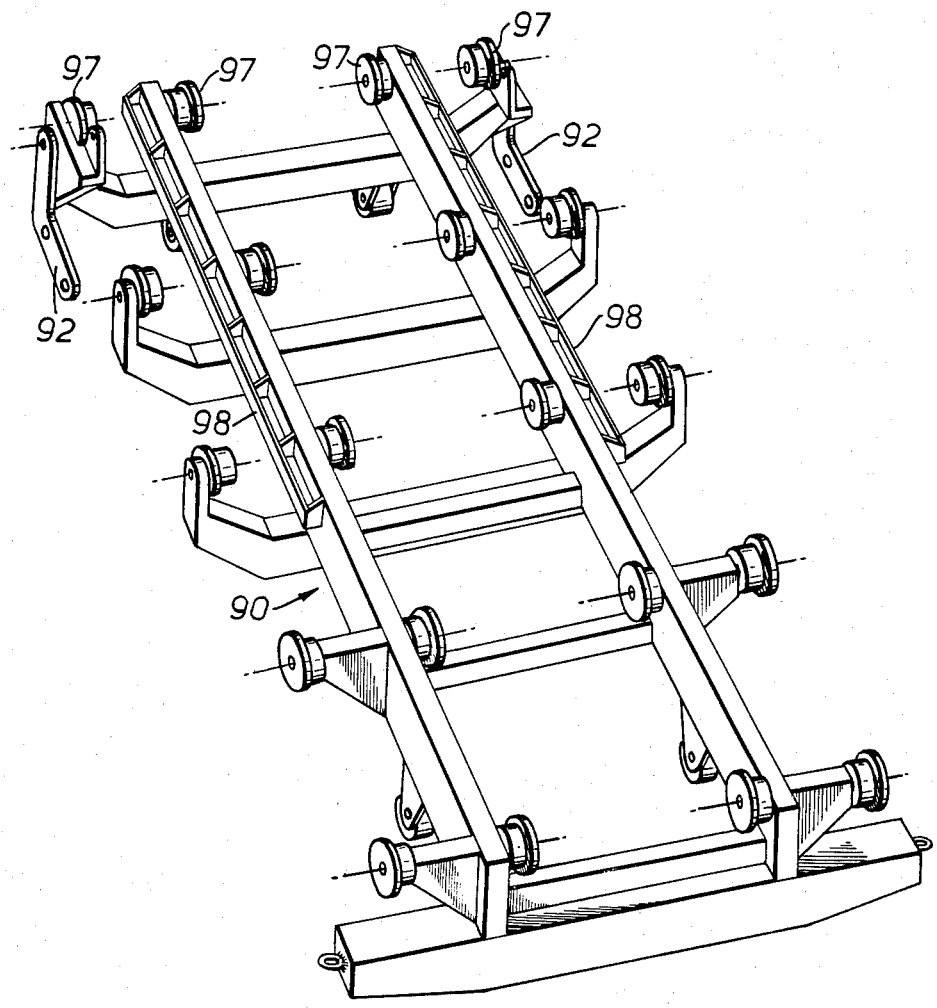
FIG. 21 shows a frame for use in the assembly of the bridge as shown in FIG. 20, FIGS. 22A, 22B, 22C, 22D, 22E, 22F, 22G and 22H show various stages of assembling the bridge of FIG. 20, and FIGS. 23A, 23B, 23D, 23E and 23F show successive stages in assembly of a bridge of FIG. 1 between two banks, typically of a river.
Figure 22A:
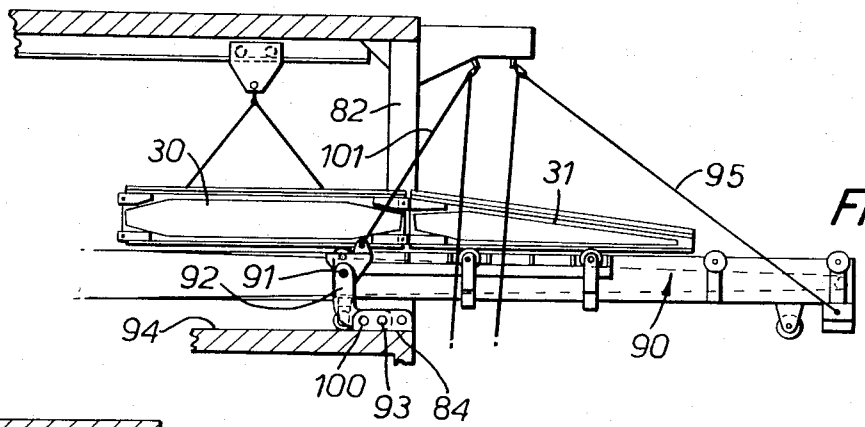
Figure 22B:
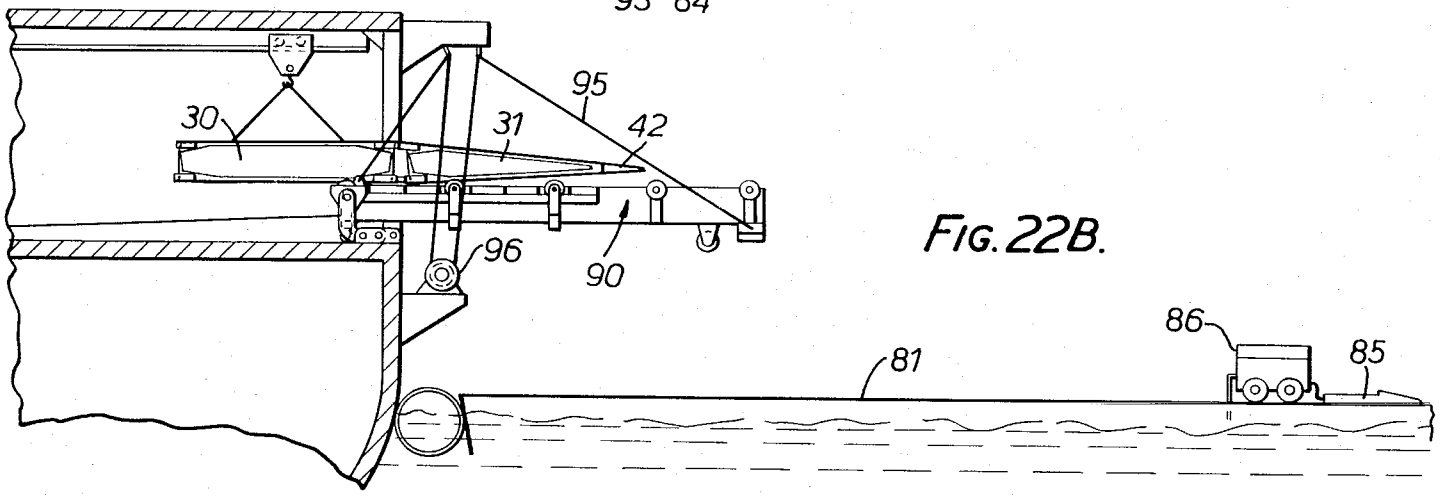

Initially the lower module 31 is supported at the aperture 82 in the ship side on a building frame indicated at 90 and shown in more detail in FIG. 21. The frame 90 is pivotally mounted about an axis 91 on L-shaped brackets 92 which are in turn pivotally mounted about an axis 93 adjacent the edge 84 of the aperture 82. In an inner position the brackets 92 are as shown in FIG. 22A and support the inner end of the frame 90 as shown above the level of the deck 94. The outer end of the frame 90 is supported by means of lifting wires 95 which are connected to a winch arrangement 96.

Figure 22C:
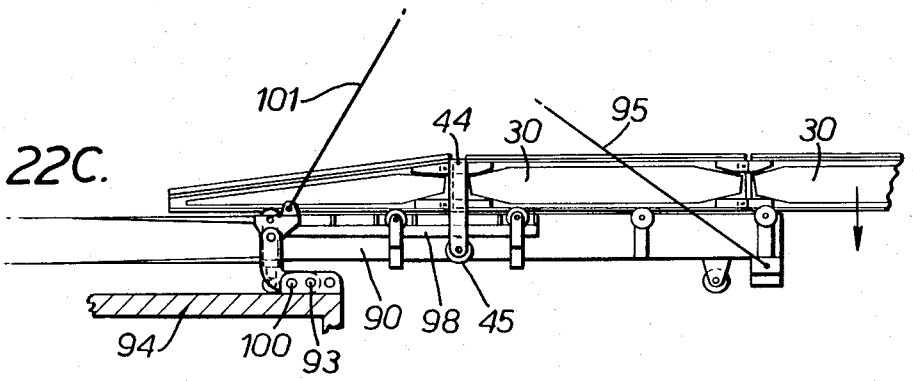
Figure 22D:
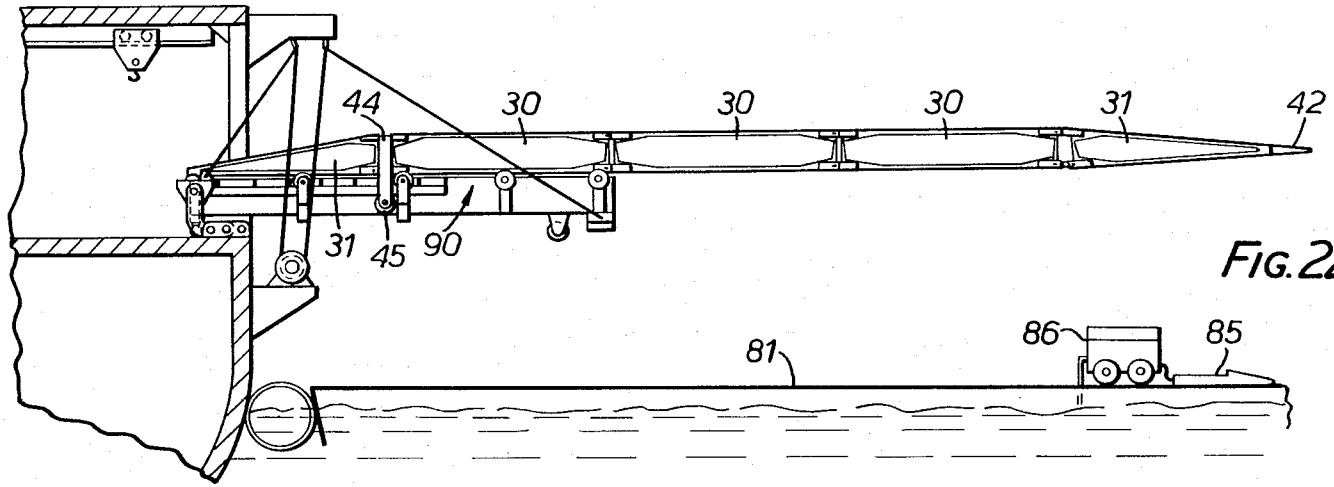

The upper part of the frame 90 is provided with a series of rollers 97 arranged to support the end edges of the main girders 32 of a module when it is in its open position. Thus the lower module 31 can be rolled out on beam 90 when it is positioned as shown in FIG. 22A and the first module 30 attached to the inboard end. Successive modules 30 are attached as shown in FIGS. 22C and 22D until the complete assembly extends out from the frame 90 as shown in FIG. 22D. A support beam 44 is assembled between the last module 30 and the inner module 31, and the rollers 45 and the beam 44 engage on the underside of rails 98 provided on the sides of the frame 90 to prevent the cantilevered assembly toppling over.

Figure 22E:
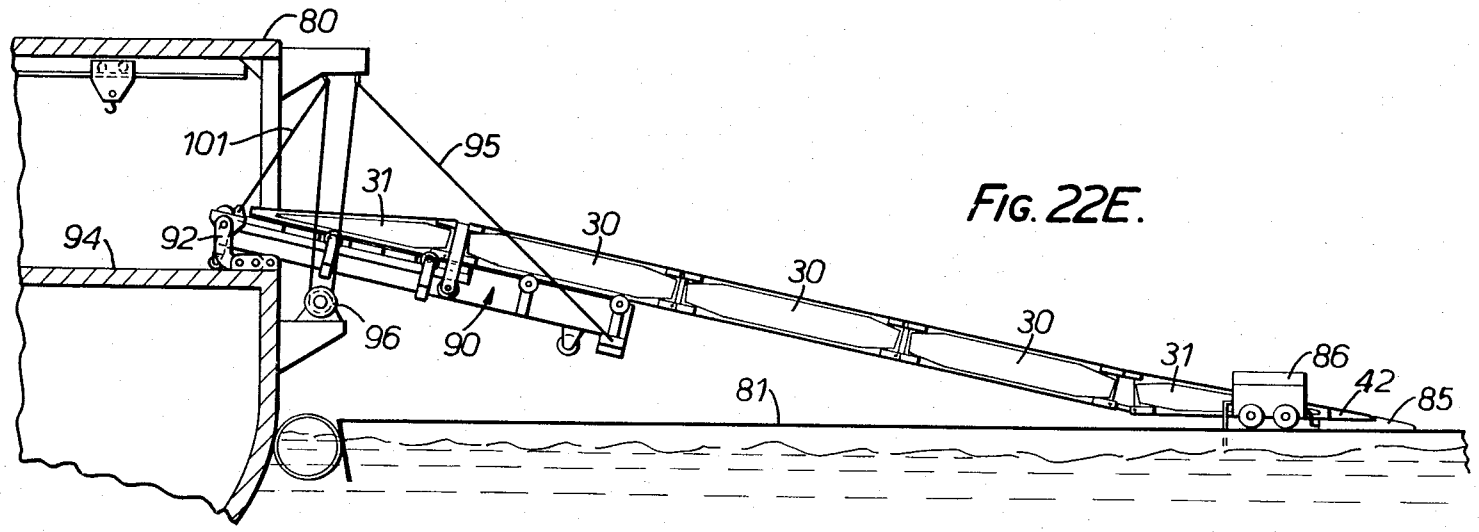
Figure 22F:
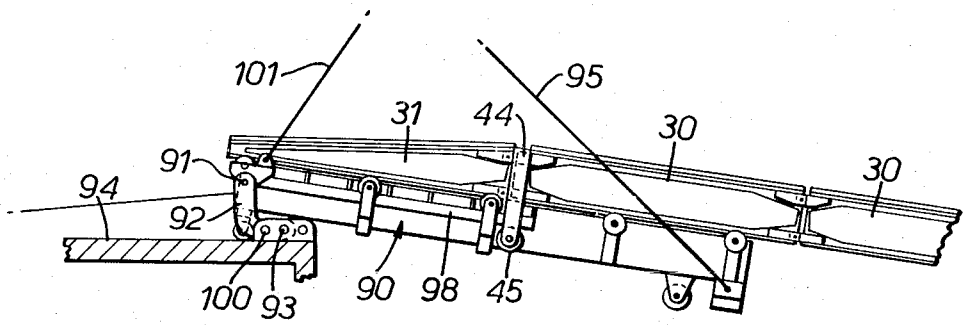

Next as shown in FIG. 22F, the winch arrangement 96 is operated to lower the frame 90 pivoting about the axis 91, to lower the outer wedge member 42 on to the support pad 85 as seen in FIG. 22E.

Figure 22G:
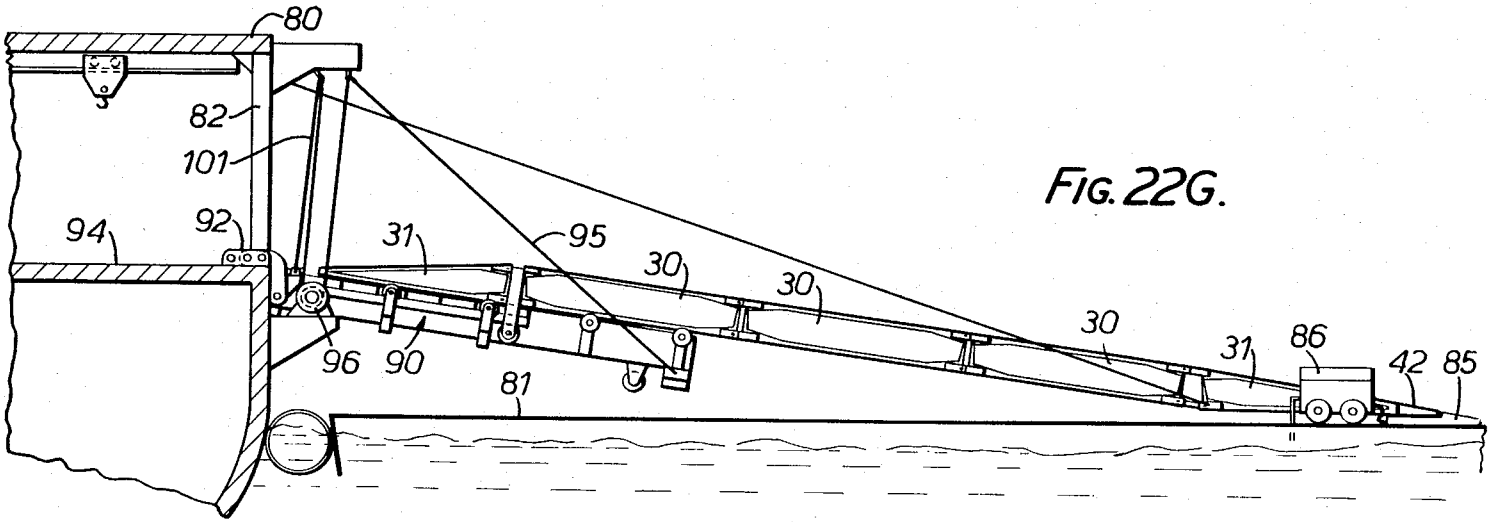
Figure 22H:
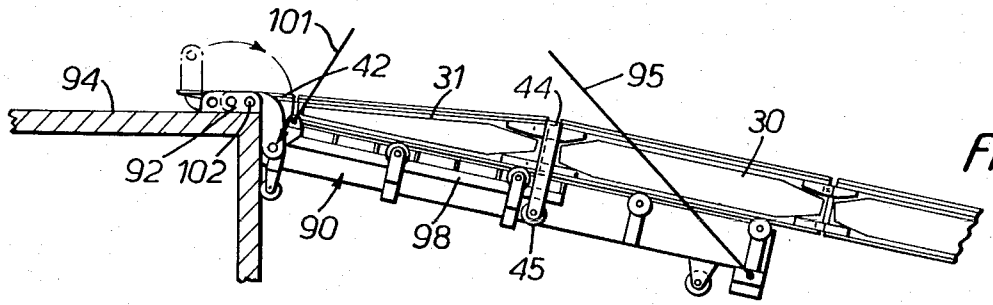

Next the brackets 92 which have been retained in the position shown in FIG. 22A by means of pins 100 are released and lifted by means of wires 101 to pivot about the axis 93 to the position shown in FIGS. 22H and 22G to lower the inner end of the frame 90 to bring the inner wedge portion 42 attached to the inner module 41, down to the level of the deck 94. The brackets 92 may then be locked in that position by means of pins 102.

Thus it can be seen that the arrangement of FIG. 20 may be assembled in a convenient manner relying only on winch equipment and accessories carried on the ship.

Figures 23A, 23B, 23C:
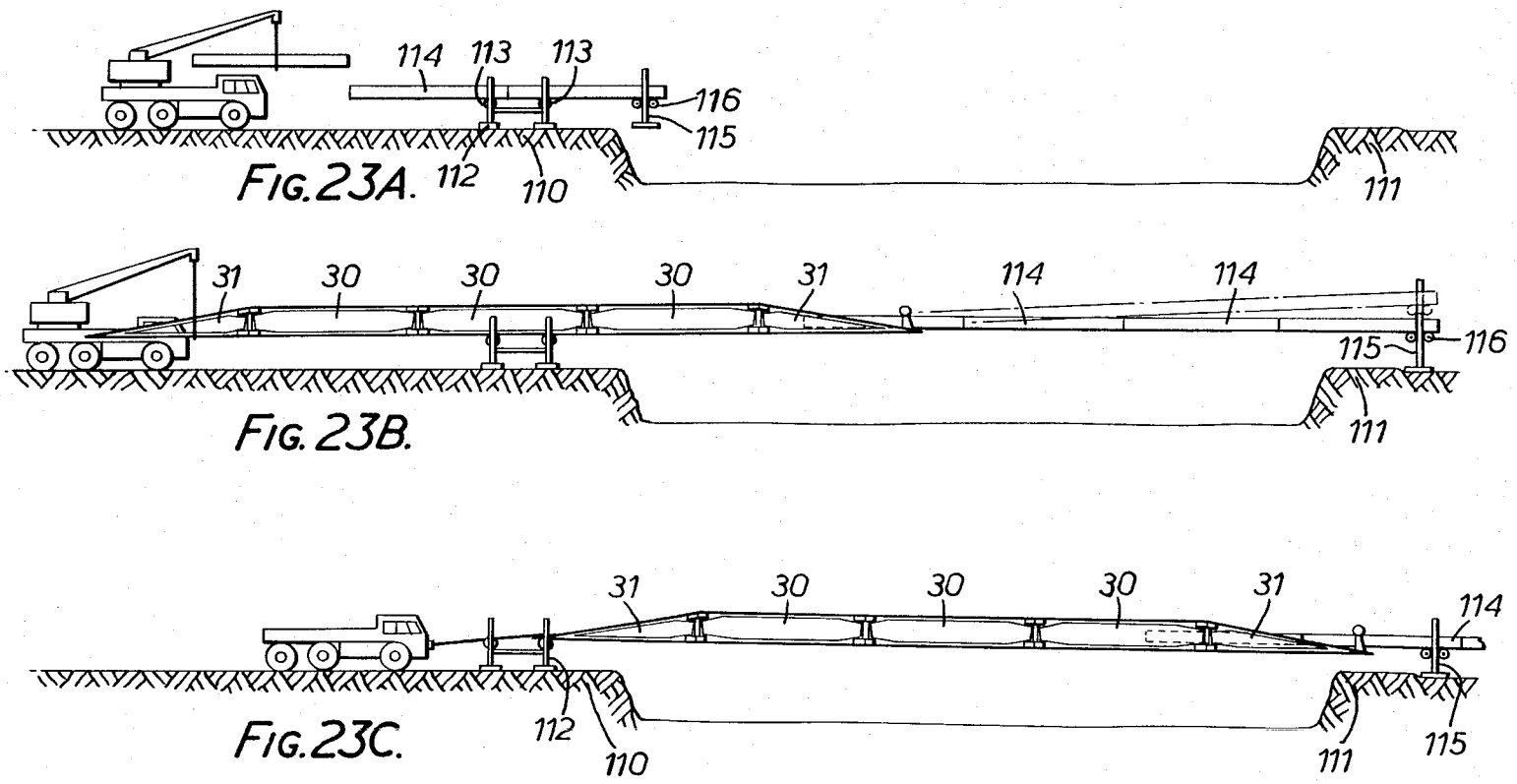

FIGS. 23A through to 23F show in schematic outline an arrangement in which an assembly such as shown in FIGS. 1 and 2 can be put together to span a gap between two banks 110 and 111.

Figure 23D:
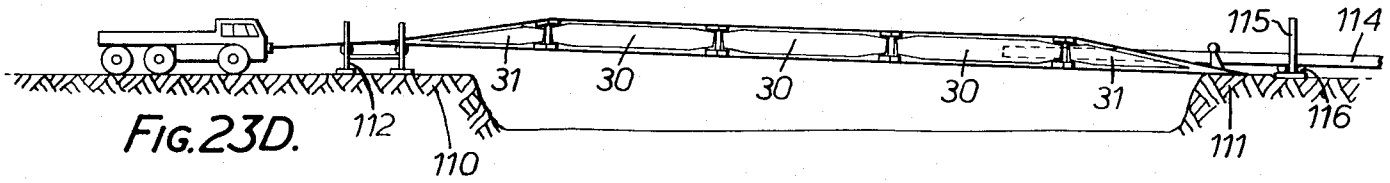
Figure 23E:
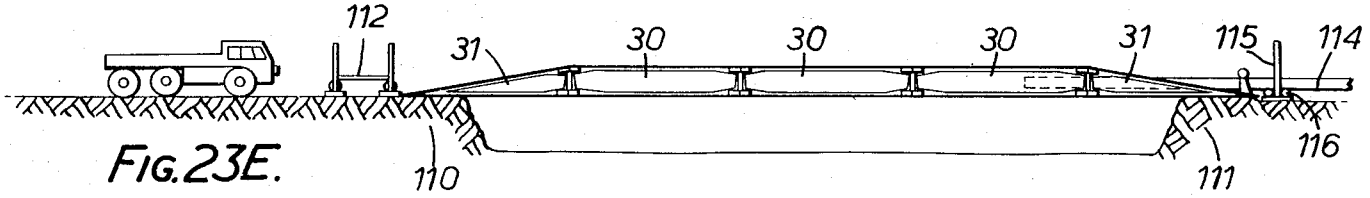
Figure 23F:
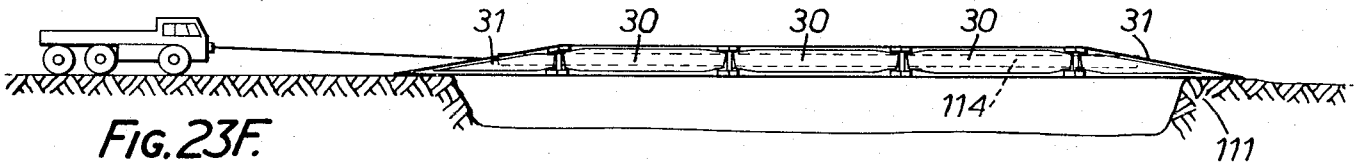

A building frame 112 is put up on the first bank 110 having upwardly facing rollers 113. A preliminary beam 114 is assembled on the frame 112 and pushed outwards towards the bank 111. The bridge assembly and modules 31 and 30 is assembled progressively on the frame 112 behind the beam 114, with the beam 114 being attached to the leading module 31. The beam 114 has at its outer end a jacking unit 115 with support rollers 116 so that when as shown in FIG. 23, the jacking unit 115 reaches the bank 111, it may rest thereon and allow the assembly of beam and bridge to roll across the gap as shown in FIG. 23C. The bridge assembly is then lowered on to the banks 110 and 111 as shown in FIGS. 23D and 23E, and the beam 114 withdrawn back through the bridge assembly as shown in FIG. 23F.

What is claimed is:

1. A bridge module comprising two longitudinal main girder structures and a central deck having a deck surface capable of supporting vehicles, and the central deck extending substantially the entire length of the module, foldable connecting means foldably connecting said main girder structures to each side of said central deck in a manner such that said main girders are foldable between an operative position in which said main girder structures provide extensions of said deck surface on either side of said central deck for use, and a closed position in which said main girder structures are folded beneath said deck.

2. The bridge module of claim 1, wherein said main girder structures are box girder structures.

3. The bridge module of claim 1, werein each main girder structure further comprises a releasable attachment means for releasably attaching said module to another module.

4. The bridge module of claim 1, wherein said deck structure comprises two lip portions and each of said main girder structures comprises a shoulder portion each of which lip portions bears on a respective one of said shoulder portions when said module is in said operative position.

5. The bridge module of claim 1, wherein said module further comprises bracing means between said main girder structures for bracing said module when in said operative position.

6. The bridge module of claim 5, wherein said bracing means comprises one or more steel wires.

7. The bridge module of claim 1 wherein said longitudinal main girder structures are constructed to be capable of supporting heavier weight vehicles than the weight of vehicles capable of being supported by the central deck.

8. A bridge comprised of a bridge module comprising two longitudinal main girder structures and a central deck having a deck surface capable of supporting vehicles, and the central deck extending substantially the entire length of the module, foldable connecting means foldably connecting said main girder structures to each side of said central deck in a manner such that said girders are foldable between an operative position in which said main girder structures provide extensions of said deck surface on either side of said central deck for use, and a closed position in which said main girder structures are folded beneath said deck.

9. The bridge module of claim 8, wherein said main girder structures are box girder structures.

10. The bridge module of claim 8, wherein each main girder structure further comprises a releasable attachment means for releasably attaching said module to another module.

11. The bridge module of claim 8, wherein said deck structure comprises two lip portions and each of said main girder structures comprises a shoulder portion, each of which lip portions bears on a respective one of said shoulder portions when said module is in said operative position.

12. The bridge module of claim 8, said module further comprises bracing means between said main girder structures for bracing said module whein in said operative position.

13. The bridge module of claim 12, wherein said bracing means comprises one or more steel wires.

14. The bridge module of claim 8 wherein said longitudinal main girder structures are constructed to be capable of supporting heavier weight vehicles than the weight of vehicles capable of being supported by the central deck.

15. A bridge comprising at least one central bridge module and two end bridge modules, each of said bridge modules comprising two longitudinal main girder structures and a central deck having a deck surface capable of supporting vehicles, and the central deck extending substantially the entire length of the module, foldable connecting means foldably connecting said main girder structures to each side of said central deck in a manner such that said main girders are foldable from an operative position in which said main girder structures provide extensions of said deck surface on either side of said central deck for use, and a closed position in which said girder structures are folded beneath said deck, said main girder structures of said end bridge modules being longitudinally tapered in depth when seen from a side of said module in its operative position, said main girder structures of said central bridge module(s) not being so tapered, and wherein each of said end bridge modules and said central bridge module(s) is in said operative position, and wherein said end bridge modules and said central bridge modules are connected together to form a bridge.

16. The bridge of claim 15, said bridge comprising additional link means between one or both of said end bridge modules and a central bridge module altering the angle of approach offered by said one or both end bridge module(s).

17. The bridge of claim 16, wherein said bridge comprises at least one beam interposed between any two modules and at least one rolling means, at least one of said rolling means being mounted on the one or each of said beams.

18. The bridge of claim 17, wherein said rolling means comprises wheels, rollers or castors.

19. The bridge of claim 15 wherein the longitudinal main girder structures of said central and end modules are constructed to be capable of supporting heavier weight vehicles than the weight of vehicles capable of being supported by the central decks.

20. A bridge module comprising: two longitudinal main girder structures and a central deck having a deck surface capable of supporting vehicles, and the central deck extending substantially the entire length of the module; foldable connecting means foldably connecting said main girder structures to each side of said central deck in a manner such that said main girders are foldable between an operative position in which said main girder structures offer extensions of said deck surface on either side of said central deck for use, and a closed position in which said main girder structures are folded beneath said deck; at least one first lifting attachment provided on each main girder structure offering said extension of said deck surface, at a position such that when lifting said module at said at least one first lifing attachment the module unfolds from a closed position to an operative position; and at least one second lifting attachment on each main girder structure provided on a surface facing the corresponding surface of the other main girder structure of the module when the module is in operative position and spaced sufficiently from the axis of pivoting of the main girder structure to the deck for having the module fold from its operative position to the closed position when lifted at said at least one second attachment.

21. The bridge module of claim 20, wherein each of said first lifting attachments is recessed.

22. A bridge comprised of a bridge module comprising: two longitudinal main girder structures and a central deck having a deck surface capable of supporting vehicles, and the central deck extending substantially the entire length of the module; foldable connecting means foldably connecting said main girder structures to each side of said central deck in a manner such that said main girders are foldable between an operative position in which said main girder structures offer extensions of said deck surface on either side of said central deck for use, and a closed position in which said main girder structures are folded beneath said deck; at least one first lifting attachment provided on each main girder structure offering said extension of said deck surface, at a position such that when lifting said module at said at least one first lifting attachment the module unfolds from a closed position to an operative position; and at least one second lifting attachment on each main girder structure provided on a surface facing the corresponding surface of the other main girder structure of the module when the module is in operative position and spaced sufficiently from the axis of pivoting of the main girder structure to the deck for having the module fold from its operative position to the closed position when lifted at said at least one second attachment;

said main girder structures of said end bridge modules being longitudinally tapered in depth when seen from a side of said module in its operative position;

said main girder structures of said central bridge module(s) not being so tapered; and wherein each of said end bridge modules and said central bridge module(s) is in said operative position, and wherein said end bridge modules and said central bridge modules are connected together to form a bridge.

23. The bridge module of claim 22, wherein each of said first lifting attachments is recessed.

* * * * *